US007416454B2

(12) United States Patent
Tamm et al.

(10) Patent No.: US 7,416,454 B2
(45) **Date of Patent: *Aug. 26, 2008**

(54) DUAL SIZE STUD ELECTRICAL CONNECTOR

(75) Inventors: Carl R. Tamm, Trussville, AL (US); Robert G. Hay, Pelham, AL (US); Brian A. Naro, Bessemer, AL (US); Lawrence E. Bradford, Sterrett, AL (US)

(73) Assignee: Hubbell Incorporated, Orange, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/812,726

(22) Filed: Jun. 21, 2007

(65) Prior Publication Data

US 2007/0249239 A1 Oct. 25, 2007

Related U.S. Application Data

(63) Continuation of application No. 11/637,189, filed on Dec. 12, 2006, now abandoned, which is a continuation-in-part of application No. 11/332,479, filed on Jan. 17, 2006, now Pat. No. 7,175,484.

(51) Int. Cl.
*H01R 11/09* (2006.01)

(52) U.S. Cl. ..... 439/798; 439/775

(58) Field of Classification Search ..... 439/775, 439/796, 797, 798, 806, 907, 921
See application file for complete search history.

(56) References Cited

U.S. PATENT DOCUMENTS

| | | | | |
|---|---|---|---|---|
| D118,588 | S | 1/1940 | Blackburn | |
| 3,133,779 | A | 5/1964 | Stanback | |
| 3,138,422 | A * | 6/1964 | Lawlor | 439/789 |
| 3,794,963 | A | 2/1974 | Cooper, Jr. | |
| 3,801,952 | A * | 4/1974 | Lawlor | 439/789 |
| 3,861,771 | A * | 1/1975 | Cornell | 439/434 |
| 4,063,794 | A * | 12/1977 | Dittmann | 439/763 |
| 4,214,806 | A | 7/1980 | Kraft | |
| 4,354,726 | A * | 10/1982 | Kato et al. | 439/763 |
| 4,382,651 | A * | 5/1983 | Klosin et al. | 439/359 |
| D302,420 | S | 7/1989 | McGrane | |
| D309,664 | S | 7/1990 | McGrane | |
| 5,221,219 | A * | 6/1993 | Thomson | 439/762 |
| 5,690,516 | A | 11/1997 | Fillinger | |
| 6,325,677 | B1 | 12/2001 | Tamm | |
| 6,347,967 | B1 | 2/2002 | Tamm | |
| 6,579,131 | B1 | 6/2003 | Ashcraft et al. | |
| 6,764,354 | B2 * | 7/2004 | Kaine et al. | 439/793 |
| 6,769,941 | B2 | 8/2004 | Norden | |
| 6,939,183 | B2 | 9/2005 | Ferretti et al. | |
| 7,014,514 | B2 * | 3/2006 | Zahnen | 439/798 |
| 7,175,484 | B1 * | 2/2007 | Tamm et al. | 439/798 |
| 2004/0067697 | A1 | 4/2004 | Zahnen | |

* cited by examiner

*Primary Examiner*—Thanh-Tam T Le
(74) *Attorney, Agent, or Firm*—Janae C. Avallone; Mark S. Bicks; Alfred N. Goodman

(57) ABSTRACT

An electrical connector for clamping securely onto a threaded shaft includes a transformer bar, a connector body, a clamping component, and at least two columns for receiving streetlight taps. The transformer bar has a plurality of conductor bores, a distal end, and a bar top. The connector body is at the distal end and has first and second bosses at the bar top and first and second clamping sides. The clamping component is pivotally mounted by an attachment link to be selectively located adjacent one of the first and second clamping sides. Two columns are located adjacent the distal end of the transformer bar, protruding away from the transformer bar, one on each side, for supporting a streetlight tap and a redundant ground close to the connector body and a streetlight tap opposite the distal end.

23 Claims, 5 Drawing Sheets

DUAL SIZE STUD ELECTRICAL CONNECTOR

CROSS REFERENCE TO RELATED APPLICATIONS

This application claims the benefit of and is a continuation of U.S. patent Ser. No. 11/637,189, filed Dec. 12, 2006 now abandoned, which claims the benefit of and is a continuation-in-part of U.S. patent Ser. No. 11/332,479, filed Jan. 17, 2006, now U.S. Pat. No. 7,175,484 issued on Feb. 13, 2007. The foregoing applications are hereby incorporated by reference in their entireties.

FIELD OF THE INVENTION

The present invention relates to an electrical connector designed to clamp securely onto a shaft, typical of a transformer bushing stud. More particularly, the invention relates to an electrical connector comprising a transformer bar, a connector body, a clamping component designed to fit two common sizes of threaded transformer bushing studs, and a plurality of columns adjacent to the distal end of the transformer bar for supporting streetlight taps and a redundant ground close to the connector body.

BACKGROUND OF THE INVENTION

Conventional electrical connectors are known for connecting the studs of transformers to wires. A transformer includes an output conductor in the form of a threaded stud which may be connected to a plurality of individual electrical conductors by a transformer stud connector. The most common methods employed for the application of making electrical connections to transformer bushing studs include: (a) screw on, (b) split screw on, (c) slip fit, (d) modified slip fit providing a saddle or nest for the threaded stud, (e) modified slip fit to accommodate two stud sizes, and (f) clamp on. All of these methods can be or have been improved.

The screw on connection relies on a jam nut to maintain a tight interface. Movement of the attached conductors promote slight amounts of torque which cause the screw on bushing stud to loosen, heat up, and eventually fail. Oftentimes, a plurality of conductors is attached to an individual stud. If failure occurs at the electrical interface of the connector or an internal fault in the transformer, all of these conductors must be removed from their respective attachment points to the stud connector. The device is rotated many times to remove it from the stud because it is threaded.

The split screw on connection evolved as a recognition of the loosening of the threaded interface. It provides a split down one side of the threaded connector and a provision for a bolt, or plurality of bolts along this split. When the connector is screwed into place, the bolts are tightened, cinching the connector about the periphery of the stud as opposed to utilizing a jam nut to maintain the secure integrity of the electrical interface. The problem of having to disconnect a plurality of conductors for the purpose of removing the connector is still prevalent.

U.S. Pat. No. 4,214,806 to Kraft discloses a slip fit connection with an internally threaded bore. The inside diameter of the bore is greater than the diameter of the crest of the threaded stud, and having an identical pitch. This connector is slipped over the threaded stud without requiring rotation. Once positioned over the stud, a set screw drives the connector into an eccentric relationship with the stud, causing the threads of equal pitch to nest with one another along the side of the inner bore. This causes a problem with the secure integrity of the electrical interface because the relationship between the stud and the bore of the connector provides only a single line interface.

The fourth type, a modified slip fit device with a saddle or nest for the threaded stud, is disclosed, e.g., in U.S. Pat. No. 5,690,516 to Fillinger. This provides a stepped stud hole having an oversize unthreaded circular hole on top and a slightly smaller intersecting hole on the bottom which provides a mating thread profile and is dimensioned to that of the stud for which it is sized. This structure improves the electrical connection by improving the integrity of the mechanical connection and providing a greater surface area for electrical interface. However, as is well known in the field of mechanical connections of a clamp design, some element of resiliency is required to provide the clamping force. The most prominent example is the elongation of bolt under tensile stress. This tensile stress, when limited within the elastic range of the material, compensates for slight dimensional changes in the bolted joint resulting from thermal changes, maintaining the integrity of the joint.

This resilient clamping force or stored mechanical energy is especially important with electrical connections, since the temperature of electrical connections varies with changes in current. The setscrew or compression screw utilized in the slip fit connectors does not offer the degree of elastic range in the joint as a bolt under tension. These connectors are predominantly aluminum, while the transformer stud bushings are copper. These two materials have differing coefficients of thermal expansion, with the aluminum expanding at a magnitude of approximately 1-½ times the rate of copper for a given increase in temperature. In operation, these connectors typically operate at a thermal rise of as much as 75° C. over ambient. The connector, being aluminum, expands at a rate greater than that of the copper stud. Not having a resilient clamping force, or stored mechanical energy in the connection, the electrical interface becomes loose, resulting in increased resistance to the joint, which results in increased temperature rise.

With the advent of a compound bar design, as taught by the U.S. Design Pat. No. 309,664 to McGrane, a provision is made for two stud receiving bores of different sizes. The two most common thread sizes of transformer bushing studs in the United States are ⅝-11 UNC and 1-14 UNS. Both sizes are in common use, depending on the size of the transformer, and it is advantageous to have a connector which accommodates either size.

The modified slip fit to accommodate two stud sizes is taught by U.S. Pat. No. 6,579,131 to Ashcraft, providing two threaded nests offset from an original slip fit bore similar to the above described modified slip fit. This design illustrates the need for securely mounting a single connector on two different transformer bushing stud sizes, yet the same problem of not providing a resilient clamping force as described above is not provided.

The clamp disclosed in U.S. Pat. No. 6,347,967 to Tamm discloses a stored mechanical energy type electrical connector. This aluminum connector is coupled onto a solid copper stud. The stud has no resiliency to provide to the connection as does a strand conductor. The greater differential of the coefficient of thermal expansion of the aluminum causes such connection to become loose as temperature increases, if it does not have the benefit of stored mechanical energy to offset thermal expansion of the aluminum.

The Tamm electrical connection can accommodate only a single stud size, and therefore, lacks the versatility needed in the present market. Further, the components of this device are not captive, resulting in the propensity of the installer to drop or lose one or more components, particularly the bolt or nut, during installation. The hazards of such loose hardware are readily apparent in an electrical enclosure.

The clamp disclosed in U.S. patent Ser. No. 11/332,479 to Tamm accommodates a transformer bar having streetlight tap wires towards its end opposite the connector component. This presents a difficult configuration for supplementing the transformer bar with streetlight taps and a redundant ground in close proximity to a stud terminal.

Accordingly, a need exists for providing a unique and improved electrical connector for attaching a clamping component to the stud terminal of an electrical device, such as is common on transformer bushings, and for providing an attachment to two different sizes of studs.

SUMMARY OF THE INVENTION

Accordingly, an object of the present invention is to provide an electrical connector having a superior clamping force and a high integrity electrical connection to bushing studs.

A further object is to provide a readily mountable and dismountable stud connector without the need to rotate the device about a threaded shaft or transformer bushing stud.

Another object is to provide a transformer connector having a plurality of main conductor bores and an auxiliary conductor bore disposed below setscrew bores arranged in offset rows.

Yet another object is to provide a connector body with an attachment link coupled to one end for rotating a clamping component around the connector body to support more than one sized electrical stud.

Still another object is to provide a transformer connector having first and second columns adjacent the connector component for supporting streetlight taps, as well as a redundant ground.

A further object is to provide an electrical connector having a plurality of streetlight taps and at least one redundant ground adjacent to one of the streetlight taps.

The foregoing objects are basically attained by providing an electrical connector comprising a transformer bar, a connector body, a clamping component, and first and second columns. The transformer bar has a plurality of conductor bores therein, a distal end, and a bar top. The connector body is at the distal end and includes first and second bosses at the bar top and first and second clamping sides. The clamping component, also including first and second bosses at its top, is pivotally mounted by an attachment link to the first and second bosses to be selectively located adjacent one of the first and second clamping sides. First and second columns adjacent the connector body at the distal end receive setscrews for supporting streetlight taps and a redundant ground.

By forming the electrical connector in this manner, positioning of the clamping component on different sides of the connector facilitates the connection of two different size studs. The position is enabled by the attachment link. Also, a streetlight tap and a redundant ground are located adjacent to two sides of the connector body.

As used in this application, the terms "top", "bottom", and "side" are intended to facilitate the description of the dual size stud electrical connector, and are not intended to limit the electrical connector of the present invention to any particular orientation.

Other objects, advantages, and salient features of the invention will become apparent from the following detailed description, which, taken in conjunction with annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
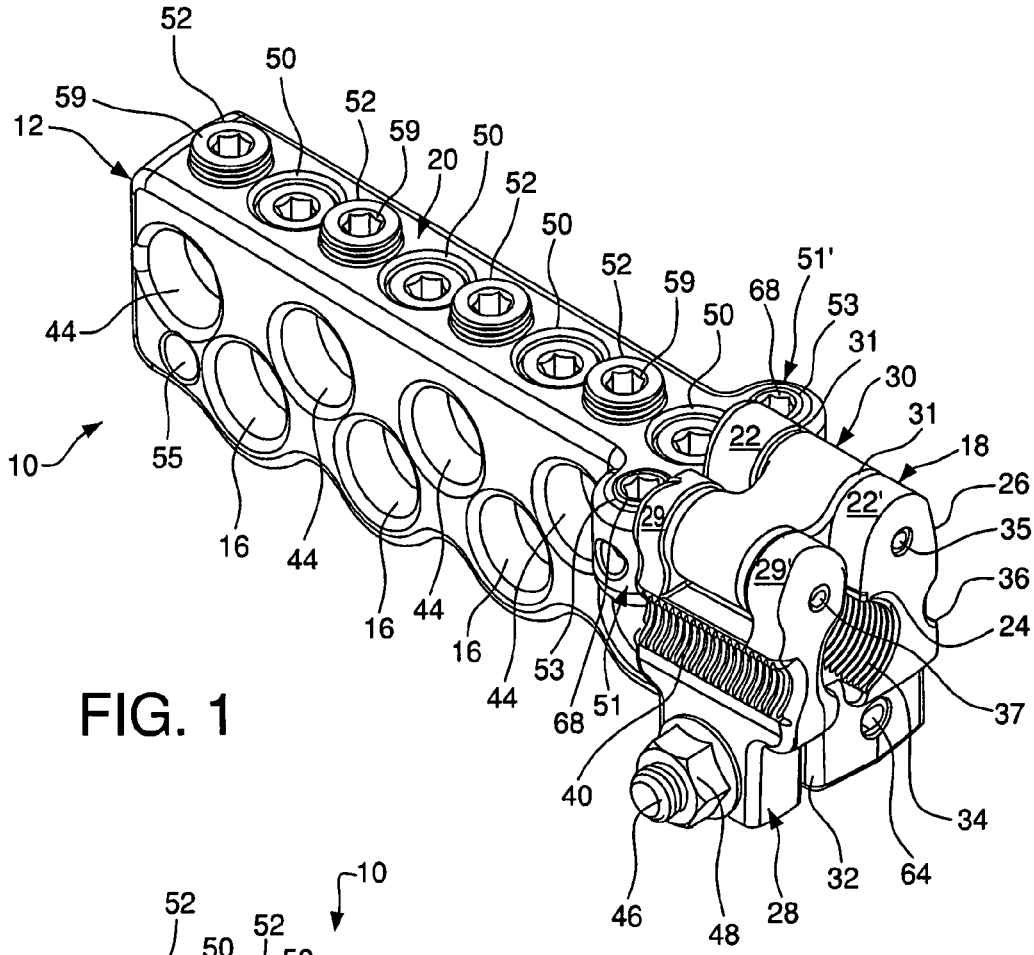
FIG. 1 is a rear, perspective view of the electrical connector, showing the flange nut tightened and the connector in a closed position as if having already received a stud of a larger size according to an embodiment of the present invention.
Figure 8:
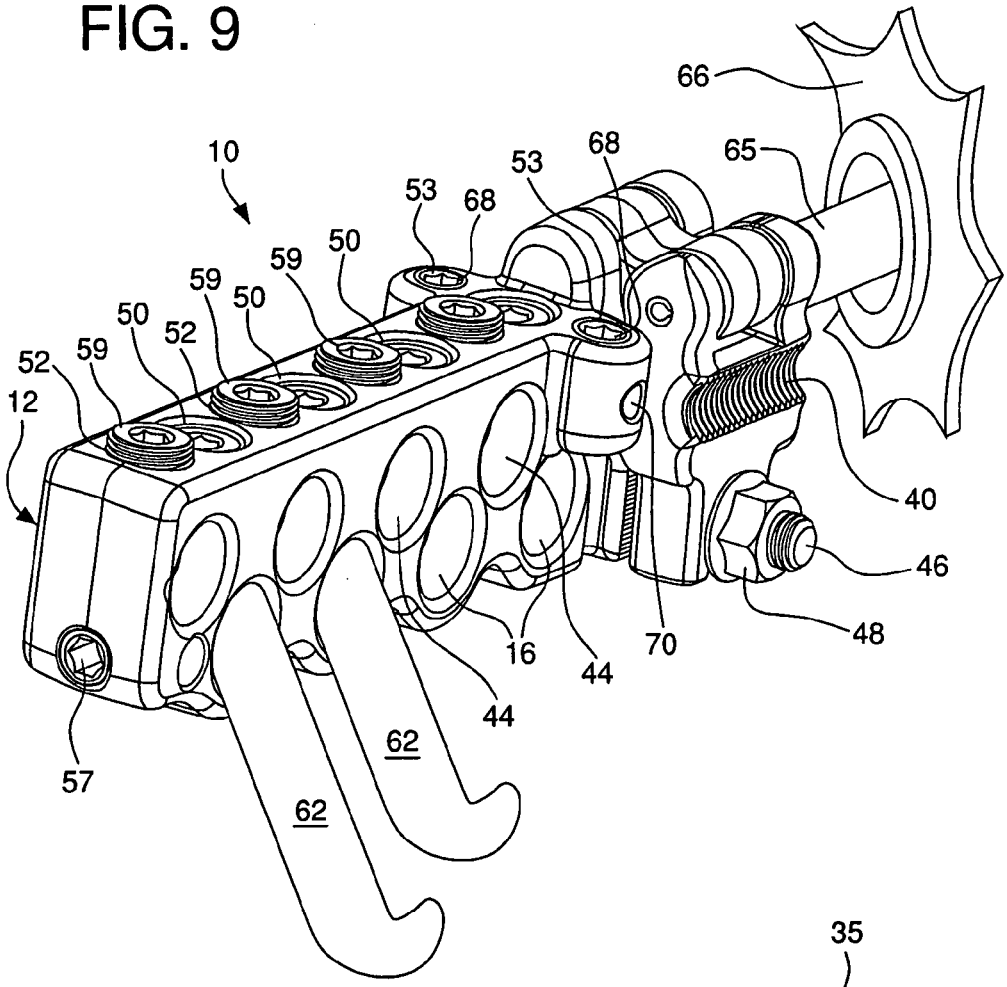
FIG. 8 is a side, perspective view of the electrical connector illustrated in FIG. 1 with the branch circuit wires positioned in the conductor bores and a large stud terminal of electrical equipment connected.

As seen in FIGS. 1 and 8, an electrical connector 10 links the stud terminal 65 of electrical equipment 66 to multiple branch-circuit wires 62. Electrical connector 10 comprises a transformer bar 12, a connector body 18, a clamping component 28, and columns 51, 51' for supporting streetlight taps. The transformer bar 12 has a plurality of conductor bores 16, 44 therein, a distal end 14, and a bar top 20. Connector body 18 is located at the distal end 14, and includes a boss 22 at the bar top 20 and first and second connector sides 24, 26. Clamping component 28 is pivotally mounted by an attachment link 30 to be selectively located adjacent one of said first and second connector sides 24, 26.

Referring to FIG. 1, the device is illustrated in its closed position, illustrating its position mounted on a larger sized stud, such as a 1-14 UNS stud. Other threaded studs can be used, such as a smaller stud, particularly a ⅝-11 UNC stud.

The elongated portion of the electrical connector 10 comprises a transformer bar 12. The transformer bar 12 is substantially rectangular in shape, and has a plurality of conductor bores 16, 44 extending transversely there through, a distal end 14, and a top 20. The conductor bores 16 are arranged in at least two offset rows. Bores 16 form a lower row, while bores 44 form an upper row. This configuration allows multiple branch circuit wires 62 to be connected to the transformer bar 12 without compromising the shape of the electrical connector 10. Although FIG. 1 illustrates eight main cable bores, more or less bores could be provided by lengthening or shortening the transformer bar 12.

The transformer bar 12 further comprises a plurality of setscrew bores 50, 52, arranged in a row above and oriented transverse to the conductor bores 16, 44. Each setscrew bore 50, 52 is internally threaded to receive a screw 59 for clamping down on a respective branch circuit wire 62. This arrangement retains the branch circuit wires 62 in the transformer bar 12 and prevents them from becoming dislodged. Each conductor bore 16, 44 corresponds to a different and respective setscrew bore 50, 52, such that alternating setscrew bores 50, 52 relate to alternating offset conductor bores 16, 44.

The setscrew bores 50 are relatively deep to reach the lowermost conductor bores 16. Each setscrew bore 50 is counter-bored to form an upper unthreaded cylindrical wall and a lower internally threaded wall extending from a bore 16. This structure of bores 50 facilitates engagement with setscrews therein.

The alternate setscrew bores 52 are relatively shallow. Each one corresponds to an upper conductor bore 44. Substantially the entire inside wall of each bore 44 is internally threaded. Setscrew bores 52 receive the retaining screws that secure the branch circuit wires 62 passing through the upper positioned conductor bores 44.

Transformer bar 12 further includes an auxiliary conductor bore 55, preferably located at the proximal end of the lower offset row of conductors 16, 44. The auxiliary conductor bore 55 receives an auxiliary conductor, typically bore sized for a #2AWG or smaller wire, e.g., one that might be used to power a street light. The auxiliary conductor bore 55 is arranged to correspond with the lower row of conductor bores 16, 44.

Figure 7:
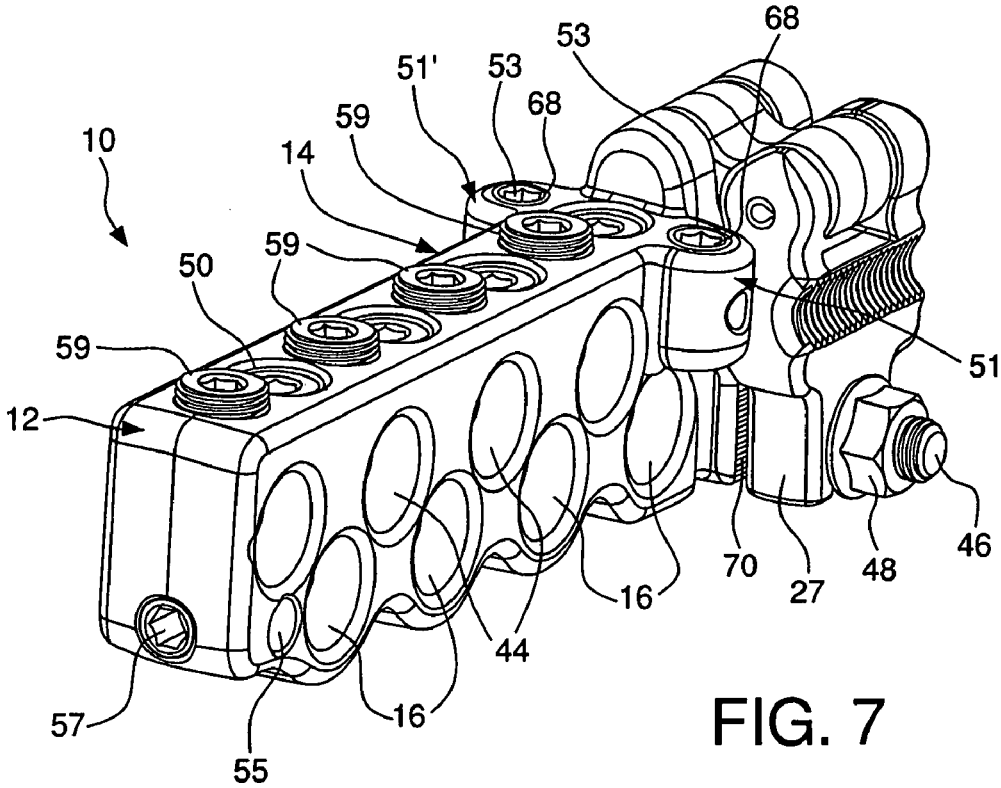
FIG. 7 is a front, perspective view of the electrical connector illustrated in FIG. 1 with the bolt and flange nut fully engaged on the clamping component.

Auxiliary conductor bore 55 has a corresponding setscrew bore 57, best seen in FIGS. 7 and 8, oriented perpendicular to auxiliary conductor bore 55. Setscrew bore 57 is internally threaded to receive a screw for retaining the auxiliary conductor in its auxiliary bore 55.

Transformer bar 12 further includes first column 51 and second column 51' for supporting streetlight taps and a redundant ground, each column 51, 51' extending away from the center of the conductor bores 16, 44. The columns 51, 51' are generally half the height of the transformer bar 12 extending from the top of the transformer bar 12 towards the middle of the transformer bar 12, but not below the upper edge of bores 16. They are located towards the distal end 14 of the transformer bar 12 and closest to the clamping component 28. Each column 51, 51' is located on an opposite side of the transformer bar 12 such that wherever the clamping component 28 acts upon the swing bolt 46, it is always adjacent to one of the first column 51 or the second column 51'.

Columns 51, 51' include streetlight setscrew bores 53 perpendicular to the conductor bores 16, 44 for receiving a screw 68. Screw 68 traps the streetlight tap and the redundant ground in the columns 51, 51' that pass through the openings 70 disposed in columns 51, 51' perpendicular to streetlight setscrew bores 53. Openings 70 are located perpendicular to streetlight setscrew bores 53. The purpose of these distally located columns 51, 51' in addition to engaging streetlight taps near the connector body 18 is also to include a redundant ground by attaching ground loop conductors near the connector body 18. Therefore, streetlight taps are supported by auxiliary conductor bore 55 and one of the streetlight bores 53 in either column 51 or column 51'. The other of the columns 51, 51' that does not support a streetlight tap through one of the openings 70 will support the redundant ground. This way, there is preferably one redundant ground always adjacent the connector body 18.

Figure 2:
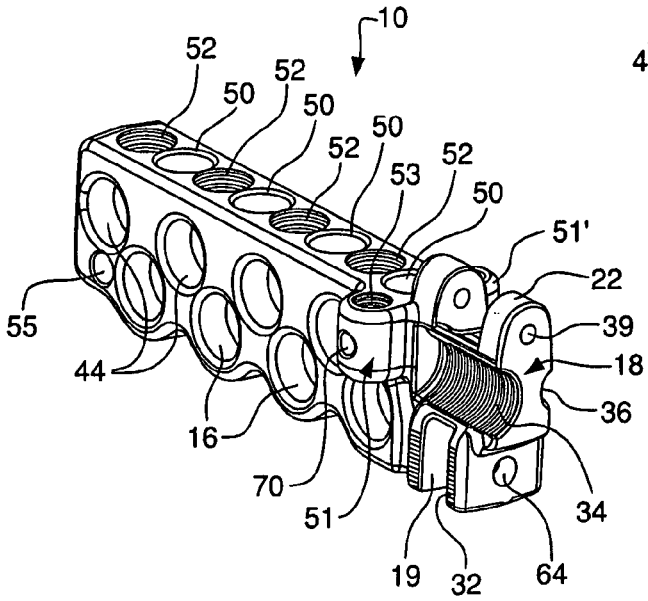
FIG. 2 is a rear, perspective view of the electrical connector of FIG. 1 without the clamping component, bolt, and attachment link.
Figure 9:
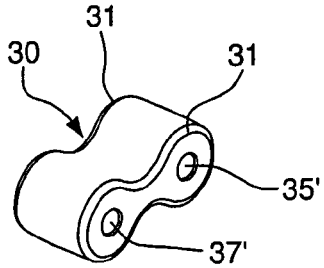
FIG. 9 is a front, perspective view of the link of FIG. 1 that attaches the clamping component to the connector.
Figure 10:
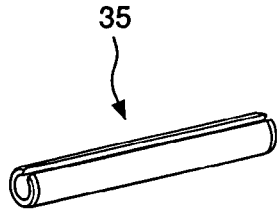
FIG. 10 is a front, perspective view of the roll pin of FIG. 1 that attaches the link of FIG. 9 to the clamping component and connector of FIG. 1.

Referring to FIG. 2, the connector body 18 is fixedly located at the distal end 14 of the transformer bar 12, opposite setscrew bore 57 and auxiliary conductor bore 55. Connector body 18 is defined by first and second bosses 22, 22' on its upper surface for receiving a pin 35, seen in FIG. 10, a first connector side 24, a second connector side 26, and a landing pad 32 for providing a positive bolting position of the clamping component 28. The bosses 22, 22' are located towards the front and back of the connector body 18 spaced apart for an attachment link 30, seen in FIG. 9, to sit therebetween.

First connector side 24 comprises a first body clamping surface 34 for supporting a larger sized stud. Second connector side 26 comprises a second body clamping surface 36 for supporting a smaller sized stud directly opposite clamping surface 34. The connector body 18 can support more than one stud size because of the larger radius of curvature on the first body clamping surface 34 and the smaller radius of curvature on the second body clamping surface 36. Each clamping surface has partial threads.

Connector body 18 comprises a circular recess or bore 64 in its bottom section walls forming landing pad 32 for receiving a pivot pin. The bottom section walls of connector body 18 adjacent to the landing pad 32 is a U-shaped cavity 19 for receiving a clamping member such as a swing bolt 46 with a flange nut 48 threaded thereon. The swing bolt 46 is pivotally coupled to the interior wall of the U-shaped cavity 19 such that it can rotate from one side of the connector body 18 to the other by the pivot pin in recess 64. To prevent the stud 65 from becoming loose and moving out of its clamped position between the connector body 18 and the clamping component 28, the flange nut 48 is tightened by rotating it around the swing bolt 46. The swing bolt 46 pivots through the U-shaped cavity 19, towards either the first connector side 24 or the second connector side 26, depending on which side of the connector body 18 is clamping a stud. The swing bolt 46 could also be pivotally coupled to the clamping component 28. In this position, the clamping component 28 controls the rotational axis of the swing bolt such that the connector body 18 would have a cavity for receiving the bolt as it pivots to aid in clamping a stud.

The clamping component 28 has first and second toggle bosses 29, 29' pivotally coupled to attachment link 30 disposed between toggle bosses 29, 29'. The attachment link 30 is pivotally connected to bosses 22, 22'. The attachment link 30 provides a toggle action that allows the clamping component 28 to pivot around the connector body 18 and clamp a stud on either side of the connector body 18, depending on the size of the stud required, with clamping component 28 substantially parallel to connector body 18 in each of the two clamping positions. Further, the clamping component 28 comprises a U-shaped recess 27 to receive the swing bolt 46 when the clamping component 28 is pivoted from one side of connector body 18 to the other. The U-shaped recess 27 is located below the clamping surfaces 38, 40.

Figure 3:
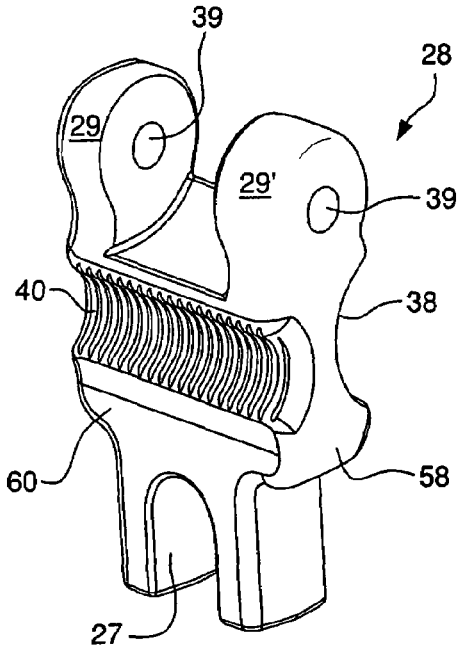
FIG. 3 is a side, perspective view of a clamping component of the electrical connector of FIG. 1.
Figure 4:
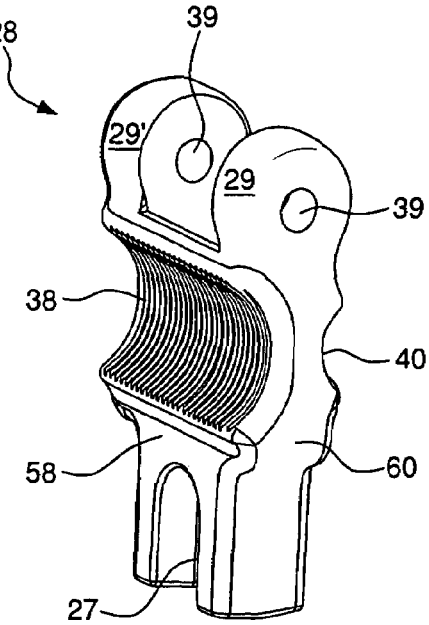
FIG. 4 is a side, perspective view of the clamping component of the electrical connector of FIG. 1 showing the opposite side from that illustrated in FIG. 3.

Clamping component 28, as seen in FIGS. 3 and 4, comprises a first clamping side 58 and a second clamping side 60, having readily accessible component clamping surfaces 38 and 40, respectively. First component clamping surface 38 is located on the first clamping side 58, and a second component clamping surface 40 is located on the second clamping side 60 directly opposite clamping surface 38 such that the longitudinal axes thereof are substantially equally distant from the pivot axis to attachment link 30. Similarly, the longitudinal axes of clamping surfaces 34 and 36 are substantially equally distant from the pivot axis of connector body 18 to attachment link 30. Distances between the clamping surfaces and the pivot axes of the clamping component are equal to those of the connector body 18. For mating with the first body clamping surface 34 and the second body clamping surface 36, first component clamping surface 38 and second component clamping surface 40 incorporate internally threaded profiles matching clamping surfaces 34 and 36, respectively of particular sizes to promote nesting of the stud 66 between the connector body 18 and the clamping component 28. At least one of the clamping surfaces 38, 40 is threaded. Preferably, first component clamping surface 38 comprises a threaded profile for the larger stud size, and second component clamping surface 40 comprises a threaded profile for the smaller sized stud. Therefore, first component clamping surface 38 has a greater radius of curvature than second component clamping surface 40.

The clamping component 28 may be provided with or without thread profiles on the first component clamping surface 38 and the second component clamping surface 40. When not provided, the first component clamping surface 38 and the second component clamping surface 40 may be comprised of any other type of textured surface which may enhance its suitability for gripping a stud.

Attachment link 30 and clamping component 28 are rotated between positions on the first connector side 24 and on the second connector 26 to align the appropriately matched clamping surfaces. Clamping surfaces that face each other, whether they be first body clamping surface 34 and first component clamping surface 38, or second body clamping surface 36 and second component clamping surface 40, always have substantially the same radii of curvature. This alignment guarantees the equipment stud 66 will be clamped all around with the correctly fitted thread. It also negates the need for a user or installer to determine any particular orientation as with devices not having captive components, and also prevents the installer from making a mistake.

Figure 5:
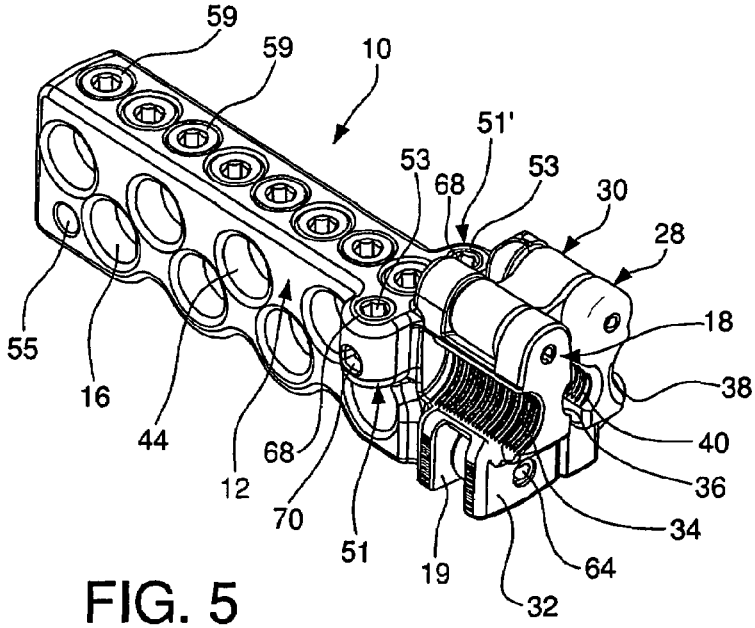
FIG. 5 is a rear, perspective view of the electrical connector of FIG. 1 with clamping component rotated over the top of the connector body after having rotated around the connector body in the process of moving between the two clamping positions.
Figure 6:
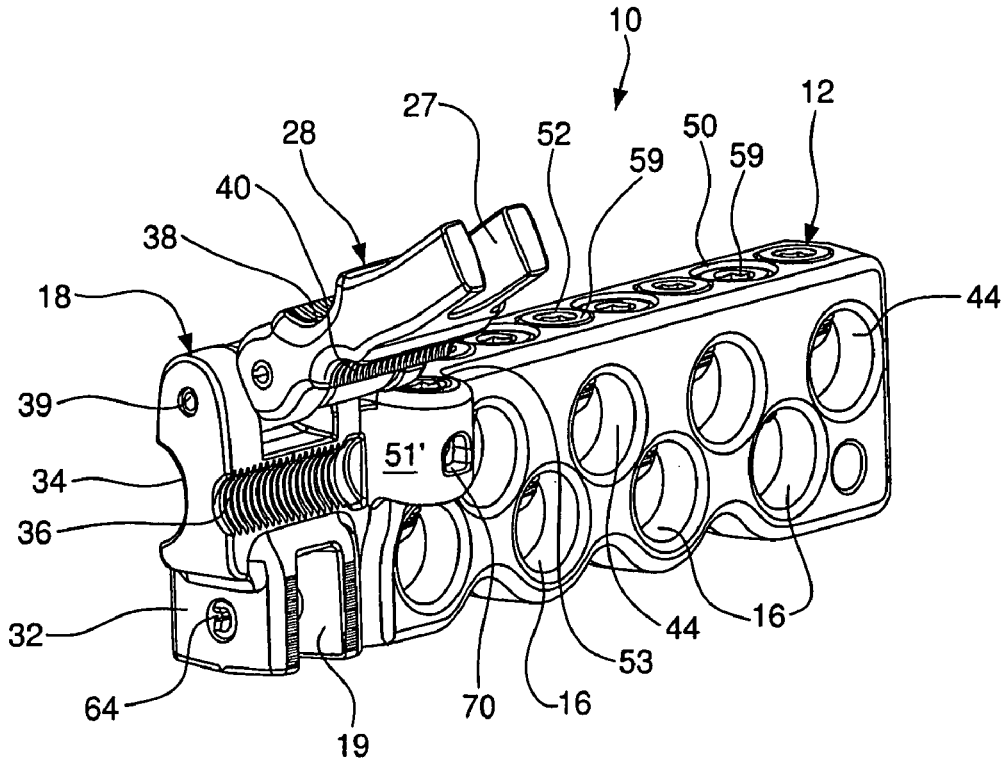
FIG. 6 is a rear, perspective view of the electrical connector illustrated in FIG. 1, showing the connector partially open to receive a stud of a smaller size.

The attachment link 30 forms a double hinged toggle clamp that connects the clamping component 28 to connector body 18. The purpose of a double hinged toggle is for the attachment link 30 to pivot around the connector body 18 and pivot the clamping component 28 with it. FIG. 5 illustrates the rotational ability of the clamping component 28. The attachment link 30 and clamping component 28 pivot around the connector body 18 to clamp onto a stud. The size of the stud 66 determines which side of the connector body 18 the clamping component 28 faces towards. FIG. 6 depicts the smaller sized clamping surfaces 36, 40 facing each other to support a smaller stud size than that illustrated in FIG. 1.

The attachment link 30 comprises a bar 31 shaped like a figure eight having two pins 35, 37 for retaining the link 30 in position with the toggle bosses 29, 29' and bosses 22, 22'. The side plate 31 is placed adjacent to the outer surfaces of the bosses 22, 22' and toggle bosses 29, 29'. The pins 35, 37 extend through bores 39 in the bosses 22, 22' and toggle bosses 29, 29' to which the attachment link 30 is connected. A first pin 35 passes through the boss 22, a bore 35', and boss 22' and the second pin 37 passes through toggle boss 29, a bore 37', and toggle boss 29'. The attachment link 30 includes two parallel bores 35', 37' for receiving the pins 35, 37, respectively, connecting the attachment link 30 to the connector body 18 and the clamping component 28. Bore 35 is located on the side of the attachment link 30 closest to the connector body 18, pin 37, and the clamping component 28. The end of each pin 35, 37 is enlarged to maintain the pivoted connections. Other types of links could be used to serve the same purpose.

Figure 11:
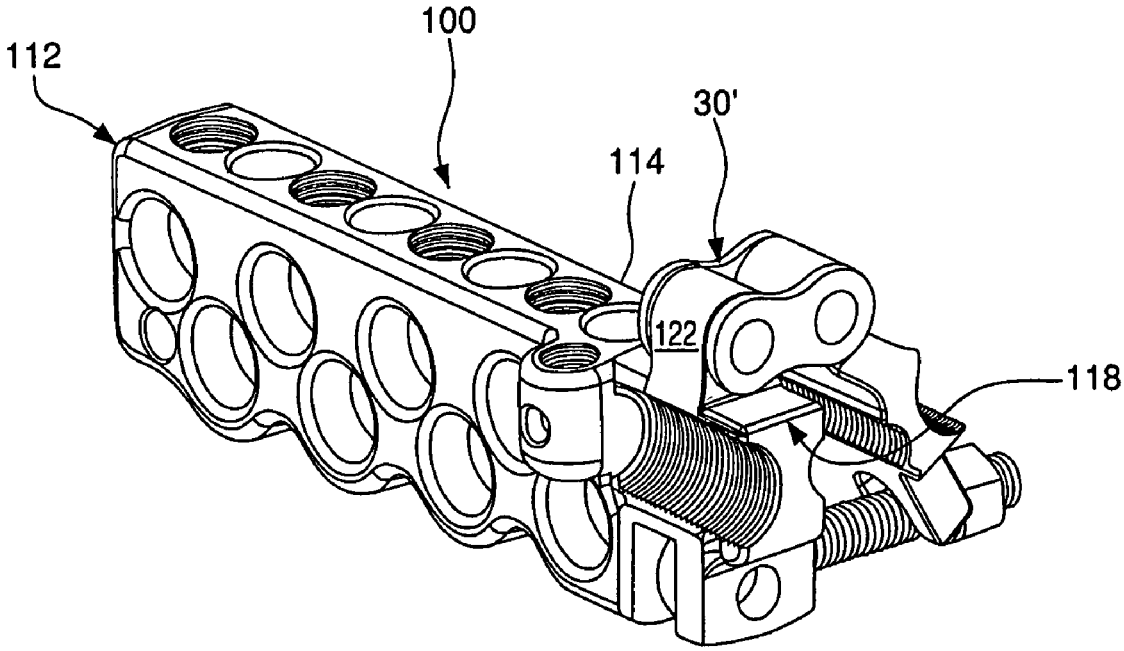
FIG. 11 is a rear, perspective view of an electrical connector according to a second embodiment of the invention.

Turning to FIG. 11, an alternative embodiment includes a standard roller chain master link as an attachment link 30'. Electrical connector 100 is similar to the above embodiment regarding the transformer bar 112, whereas the connector body 118 adjacent the distal end 114 is more akin to the parent application having a single boss 122 adjacent to the master chain link disclosed in U.S. patent Ser. No. 11/332,479, which is hereby incorporated by reference in its entirety.

A landing pad 32, against which the clamping component 28 is tightened, is of particular thickness dimension to limit the travel of the clamping component 28 on each respective side, such that an elastic deflection is achieved in the clamping component 28, resulting in a spring like clamping force of stored mechanical energy. When the clamping component 28 is nested firmly or abuts against the landing pad 32, an electrical interface between connector body 18 and clamping component 28 is created under the tension of the swing bolt 46 to maintain contact at this interface.

Swing bolt 46 with captive flange nut 48 applies the clamping force to secure the electrical connector 10 to the stud. Clamping component 28 constitutes a resilient beam component which flexes within its elastic range. The resilient beam component combined with the elastic strain of the bolt under tension creates a stored energy clamp of the maximum force on either stud size. An appropriately sized boss 22 or landing pad 32 provides enough support of the clamping component 28 on each respective side such that the installer need not be concerned with torque load on the bolt. The installer tightens the flange nut 48 towards the U-shaped recess 27 until the clamping component 28 contacts the landing pad 32, thus preventing the installer from overstressing the resilient beam provision of the clamping component 28. From the FIG. 7 positions, when the flange nut 48 is loosened, bolt 46 is pivoted to disengage clamping component 28 to allow release of the previously clamped stud or to swing around the connector body 18 to clamp another sized stud to the opposite side, as seen in FIG. 8.

As illustrated, the connector body 18 and the clamping component 28 are threaded to support at least two different, but common sizes of transformer studs. Once the clamping component 28 is rotated adjacent on a face of the connector body 18, it is positioned to be connected to a stud of the appropriate thread size. Following insertion of the stud between the connector body 18 and the clamping component 28, flange nut 48 is tightened, bringing the clamping component 28 into intimate contact with the connector body 18, and elastically deflecting the clamping component 28 over the solid appropriate sized thread transformer 12 bushing stud.

The ability of the electrical connector 10 to accommodate a large or small stud size by merely rotating the clamping component 28 might be necessary where houses or electrical equipment are built in an area that is served by one transformer, but the load grows to require a larger transformer. The existing main conductors could remain attached, essentially undisturbed, while only the swing bolt and toggle clamp are loosened, the old smaller transformer removed, and the new larger unit installed in its place. The connectors would simply be reconfigured to accommodate the larger studs of the new transformer.

According to the above embodiments, an electrical connector may be coupled with a setscrew type transformer bar as in the accompanying figures, or it could be an integral part of other types of connectors utilized with a threaded stud, such as a paddle type to which a plurality of lugs might be attached. An electrical connector, as described and illustrated above, could also be utilized with a single cable connection, a tubular buss type connection, or any of several other styles of conductors which may be connected to a transformer stud.

While the invention as illustrated is contemplated to be manufactured of aluminum, or an alloy thereof, it will be appreciated that the same device could be made of copper, or an alloy thereof, or some other conductive material if the application is to require an electrical interface. However, certain relative dimensions and proportions as depicted in the accompanying illustrations might be changed to create the optimum elastic deflection in the attachment link component.

When particular embodiments have been chosen to illustrate the invention, it will be understood by those skilled in the art that various changes and modifications can be made therein without departing from the scope of the invention as defined in the appended claims.

What is claimed is:

1. An electrical connector, comprising:

a transformer bar having a plurality of conductor bores therein, a distal end, a bar top;

a connector body at said distal end having at least one boss at said bar top and having first and second connector sides;

a clamping component pivotally mounted by an attachment link to said boss to be selectively located adjacent each of said first and second connector sides; and first and second columns adjacent said distal end, protruding away from said transformer bar.

2. An electrical connector according to claim 1 wherein said connector body includes first and second bosses.

3. An electrical connector according to claim 2 wherein said attachment link is pivotally mounted to said bosses, said bosses located towards said distal end.

4. An electrical connector according to claim 1 wherein a clamping member is securable to said clamping component and said connector body to force said clamping component and said connector body toward one another.

5. An electrical connector according to claim 1 wherein said connector body comprises first and second concavely curved body clamping surfaces on said first and second connector sides, respectively, said first body clamping surface having a greater radius of curvature than said second body clamping surface; and said clamping component comprises first and second concavely curved component clamping surfaces on first and second component sides thereof, said first component clamping surface having a greater radius of curvature than said second component clamping surface.

6. An electrical connector according to claim 1 wherein each of said columns includes a streetlight setscrew bore perpendicular to said conductor bores; and an opening disposed in each of said columns perpendicular to said setscrew bores.

7. An electrical connector according to claim 5 wherein said first and second columns are located on opposite sides of said transformer bar, one of said columns corresponding to first body clamping surface and the other of said columns corresponding to second body clamping surface.

8. An electrical connector according to claim 1 wherein the plurality of conductor bores of said transformer bar are arranged in at least two offset rows.

9. An electrical connector according to claim 8 wherein said transformer bar comprises a plurality of setscrew bores arranged in a row above the conductor bores and substantially oriented perpendicularly to the conductor bores.

10. An electrical connector according to claim 9 wherein said transformer bar comprises at least one bore at the end of one of said rows that is an auxiliary conductor bore.

11. An electrical connector according to claim 10 wherein at least one bore is perpendicular to said auxiliary conductor bore.

12. An electrical connector according to claim 2 wherein said clamping component is a toggle clamp with first and second toggle bosses on a top thereof.

13. An electrical connector according to claim 5 wherein at least one of said clamping surfaces is threaded.

14. An electrical connector according to claim 1 wherein one of said connector body and said clamping component has a bolt pivotally coupled thereto; and the other of said connector body and said clamping component has a U-shaped recess for receiving said bolt.

15. An electrical connector according to claim 14 wherein said bolt pivots about an axis perpendicular to a longitudinal axis thereof from a first side of one of said connector body and said clamping component to a second side of the same of said connector body and said clamping component; and a flange nut is threadedly received on said bolt for securing said bolt to the second side.

16. An electrical connector according to claim 14 wherein said bolt is pivotally coupled to said connector body; and said U-shaped recess is on said clamping component.

17. An electrical connector according to claim 1 wherein each of said first and second columns receives a streetlight setscrew bore and one of said first and second columns includes an opening located perpendicular to said streetlight setscrew bore for supporting a streetlight tap; and the other of said first and second columns includes an opening located perpendicular to said setscrew bore for supporting a redundant ground.

18. An electrical connector according to claim 1 wherein said connector body comprises first and second concavely curved body clamping surfaces on said first and second connector sides, respectively, said first body clamping surface having a greater radius of curvature than said second body clamping surface.

19. An electrical connector according to claim 1 wherein said clamping component comprises first and second concavely curved component clamping surfaces on first and second component sides thereof, said first component clamping surface having a greater radius of curvature than said second component clamping surface.

20. An electrical connector, comprising:

a transformer bar having a plurality of conductor bores therein arranged in at least two offset rows to receive a plurality of branch circuit wires, a distal end for supporting a connector body, a bar top having a plurality of bores receiving a plurality of screws to retain the branch circuit wires, and first and second columns protruding from said distal end, located at opposite sides of said transformer bar;

a connector body at said distal end having first and second bosses at said bar top and having first and second connector sides, said connector body having first and second concavely curved body clamping surfaces on said first and second connector sides, respectively, said first body clamping surface having a greater radius of curvature than said second body clamping surface;

a clamping component pivotally mounted by an attachment link to said first and second bosses to be selectively located adjacent one of said first and second connector sides, said clamping component having first and second concavely curved component clamping surfaces on first and second sides thereof respectively, said first component clamping surface having a greater radius of curvature than said second component clamping surface, said first clamping surfaces have substantially equal radii of curvature and said second clamping surfaces have another substantially equal radii of curvature smaller than the radii of curvature of said first clamping surfaces;

a bolt pivotally coupled to one of said connector body and said clamping component to force said clamping component and said connector body toward one another, the other of said connector body and said clamping component having a U-shaped recess for receiving said bolt; and a flange nut threaded on said bolt for securing said connector body and said clamping component together.

21. An electrical connector according to claim 20 wherein said first and second columns are located on opposite sides of said transformer bar, one of said columns corresponding to first body clamping surface and the other of said setscrew columns corresponding to second body clamping surface.

22. An electrical connector according to claim 20 wherein said transformer bar comprises a plurality of setscrew bores arranged in an row above the conductor bores and substantially oriented perpendicularly to the conductor bores;

at least one bore at the end of one of said rows is an auxiliary conductor bore; and at least one bore is perpendicular to said auxiliary conductor bore.

23. An electrical connector according to claim 20 wherein each of said columns receives a streetlight setscrew bore and one of said columns includes an opening located perpendicular to said streetlight setscrew bore for supporting a streetlight tap; and the other of said columns includes an opening located perpendicular to said setscrew bore for supporting a redundant ground.

* * * * *